US011202735B2

(12) United States Patent
Brandenburger

(10) Patent No.: US 11,202,735 B2
(45) Date of Patent: Dec. 21, 2021

(54) CONNECTION ASSEMBLY FOR CONDUCTING A MEDICAL LIQUID

(71) Applicant: Fresenius Kabi Deutschland GmbH, Bad Homburg (DE)

(72) Inventor: Torsten Brandenburger, Reichelsheim (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 373 days.

(21) Appl. No.: 15/576,438

(22) PCT Filed: May 23, 2016

(86) PCT No.: PCT/EP2016/061582
§ 371 (c)(1),
(2) Date: Nov. 22, 2017

(87) PCT Pub. No.: WO2016/188957
PCT Pub. Date: Dec. 1, 2016

(65) Prior Publication Data

US 2018/0153770 A1 Jun. 7, 2018

(30) Foreign Application Priority Data

May 22, 2015 (EP) ..... 15168952

(51) Int. Cl.
*A61J 1/20* (2006.01)
*A61J 1/10* (2006.01)
*A61J 1/14* (2006.01)

(52) U.S. Cl.
CPC ..... *A61J 1/2048* (2015.05); *A61J 1/10* (2013.01); *A61J 1/1406* (2013.01); *A61J 1/201* (2015.05);
(Continued)

(58) Field of Classification Search
CPC ..... A61J 1/2048; A61J 1/201; A61J 1/2027; A61J 1/2044
See application file for complete search history.

(56) References Cited

U.S. PATENT DOCUMENTS 7,967,797 B2 6/2011 Winsor et al.
8,025,646 B2 9/2011 Fukai et al.
(Continued)

FOREIGN PATENT DOCUMENTS

CN 102164628 B 3/2016
EP 1 217 284 6/2002
(Continued)

OTHER PUBLICATIONS

International Search Report and Written Opinion issued in PCT/IB2020/051987, dated Apr. 20, 2020.

*Primary Examiner* — Tatyana Zalukaeva
*Assistant Examiner* — Jessica R Arble
(74) *Attorney, Agent, or Firm* — BakerHostetler

(57) ABSTRACT

A connection assembly for conducting a medical liquid, comprising a connection piece, an attachment part attached to the connection piece; an opening into which the connection piece engages; and a seal element for sealing a passage between the connection piece and the attachment part. The seal element is held between the attachment part and the connection piece and has a sealing head, which closes the opening of the attachment part against the passage of liquid when the attachment part is attached to the connection piece, and a body, which adjoins the sealing head and which can be arranged in the opening at a radial distance to the attachment part.

22 Claims, 9 Drawing Sheets

Figure 1:
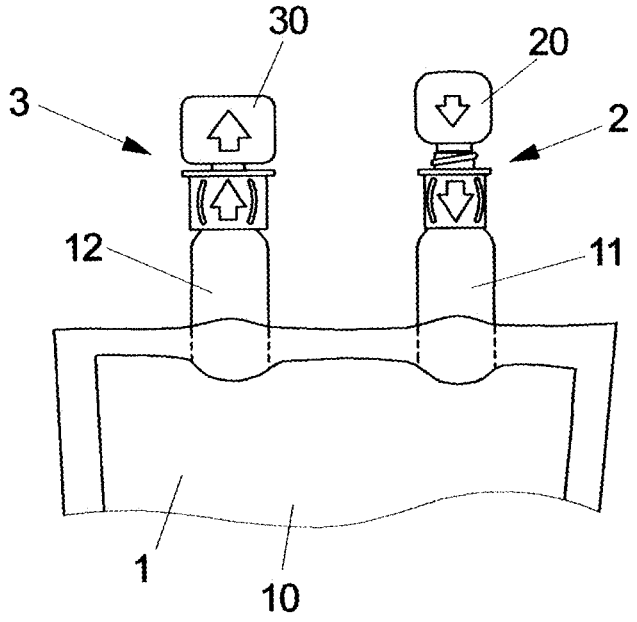

(52) U.S. Cl.
CPC ..... *A61J 1/2027* (2015.05); *A61J 1/2044* (2015.05); *A61J 1/2096* (2013.01)

(56) References Cited

U.S. PATENT DOCUMENTS

| | | | | |
|---|---|---|---|---|
| 8,585,674 | B2 | 11/2013 | Brandenburger et al. | |
| 9,095,500 | B2 | 8/2015 | Brandenburger et al. | |
| 10,576,019 | B2 | 3/2020 | Brandenburger | |
| 2003/0141477 | A1* | 7/2003 | Miller | F16K 15/185 251/149.1 |
| 2006/0206059 | A1 | 9/2006 | Lopez | |
| 2008/0009783 | A1 | 1/2008 | Branderburger et al. | |
| 2008/0190485 | A1* | 8/2008 | Guala | A61M 39/045 137/1 |
| 2010/0298782 | A1 | 11/2010 | Winsor et al. | |
| 2011/0166532 | A1 | 7/2011 | Brandenburger et al. | |
| 2011/0282302 | A1 | 11/2011 | Lopez et al. | |
| 2014/0075756 | A1 | 3/2014 | Winsor et al. | |
| 2015/0297454 | A1* | 10/2015 | Sanders | A61J 1/2096 604/414 |
| 2016/0030730 | A1* | 2/2016 | Mosler | A61M 39/225 604/508 |
| 2016/0114147 | A1 | 4/2016 | Siopes et al. | |
| 2018/0092807 | A1 | 4/2018 | Brandenburger | |
| 2020/0046608 | A1 | 2/2020 | Brandenburger et al. | |

FOREIGN PATENT DOCUMENTS

| | | | |
|---|---|---|---|
| EP | 1 470 352 | | 10/2004 |
| WO | WO93/11828 | | 6/1993 |
| WO | 98/26835 | A1 | 6/1998 |
| WO | WO2005/037362 | | 4/2005 |
| WO | WO2010/034470 | | 4/2010 |
| WO | 2010151507 | A1 | 12/2010 |
| WO | 2016188957 | A1 | 12/2016 |
| WO | 2018065596 | A1 | 4/2018 |

* cited by examiner

CONNECTION ASSEMBLY FOR CONDUCTING A MEDICAL LIQUID

CROSS REFERENCE TO RELATED APPLICATIONS

This application is the national phase under 35 USC 371 of international application no. PCT/EP2016/061582, filed May 23, 2016, which claims the benefit of the priority date of European application no. 15168952.8, filed May 22, 2015. The contents of the aforementioned applications are incorporated herein in their entirety.

DESCRIPTION

The invention relates to a connection assembly for directing a medical liquid according to the preamble of claim 1.

Such a connection assembly can be used, for example, on a container for medical liquids in the form of, for example, a flexible bag, an ampule or some other bottle in order to direct a medical liquid into, or remove it from, the container. Such a connection assembly can also be described briefly as a connector.

In a connector for a medical-liquid-containing packaging known from WO 2005/037362 A1, a self-sealing membrane is inserted into a channel-like recess of a connecting part. The channel-like recess is sealed off by a detachable part that can be broken off to release the channel-like recess from the connecting part, so that a syringe with connecting piece can be attached to the connecting part. By attaching the syringe to the connector, the membrane can be opened so that a liquid in a container can be delivered into or out of the container.

In the case of a connector known from WO 2010/034470 A1, a hollow body having a point is arranged on one side of a membrane that faces away from a syringe to be attached to the membrane. The hollow body supports the opening of the membrane. When the syringe is attached to the connector, the membrane is pressed by the syringe onto the point of the hollow body so that the syringe engages with the hollow body and thus enables flow through the membrane and the hollow body.

A valve unit having a hollow body that supports the opening of a membrane is also described in WO 93/11828 A1. The document shows a needle-free valve unit having a tubular body that defines an internal cavity. The valve unit additionally includes a hollow spike with an enclosed tip arranged in the cavity. The valve unit further includes an elastic silicone seal which closes the valve unit and covers the point of the spike. The seal has a sealing head, a conical side wall and a lower sealing lip. The lower sealing lip is clamped between an annular sleeve and the underside of a ring.

Such connectors are used, for example, to create so-called needle-free access to a container, such as a bag or a bottle, which holds medical liquid in order to fill the container with liquid or remove liquid from the container via the access. Such needle-free access provides entry to the container using a delivery device that has no injection needle. Instead, a connecting piece for a delivery device in the form of a syringe, for example, is incorporated into a slot opening of a sealing element in order to open the slot opening in this manner and allow flow between the delivery device and the container.

By using needle-free access, the risk of injury in particular, which would otherwise be present when using injection needles, can be reduced.

Even if the sealing element provided is already sterile, legal requirements can make it necessary to wipe or dab off the outside of the delivery device before attaching the delivery device to the attachment part. This should ensure access to a container, for example, under sterile conditions. Such connectors that can be dabbed or wiped are known, for example, from EP 1 470 352 B1 and EP 1 217 284 B1.

US 2010/0298782 A1 describes an intravascular valve component which has a valve housing and a flexible, pressure-activated pressure control valve. The housing includes a proximal and a remote housing part which are connected to one another. The valve includes a slotted central valve wall and an annular flange that surrounds the valve wall. The flange has a flange wall that extends radially and a protrusion that extends axially from the flange wall. The protrusion engages with a part of the valve housing in order to minimize the radial movement of the valve relative to the housing.

The object of the present invention is to provide a connection assembly to guide a medical liquid which is reliably secured but which also allows a certain mobility of the sealing element. The flow, in particular should not be significantly affected by this. Another object comprises the provision of a connection assembly in which the wiping or dabbing off of the sealing element for the purpose of disinfection is made possible.

This object is achieved by a subject having the features of claim 1.

It is a connection assembly for directing a medical liquid. It includes a connector through which a medical liquid is delivered and an attachment part attached to a connector which can be connected to a delivery device for delivering a medical liquid through the connector. Preferably, the attachment piece has an opening that engages with the connector when the attachment part is attached to the connector. The connection assembly also includes a sealing element for sealing the transition between the connector and the attachment part. The sealing element is preferably inserted into the opening of the attachment part in an insertion direction in such a manner that the sealing element is held on the attachment part attached to the connector between the attachment part and the connector. In particular, the interior of the sealing element is free of any body having a point intended to support the opening of the sealing element.

The sealing element has a sealing head that seals off the opening of the attachment part from liquid passage when the attachment part is attached to the connector and a body adjoining the sealing head that is or can be arranged with radial distance from the attachment part in the opening.

The sealing element has

- a shoulder at the transition between the sealing head and the body that projects radially with respect to the insertion direction through the sealing head and along the insertion direction can be brought into contact with a contact surface inside the opening of the attachment part and
- a flange which protrudes along the insertion direction at a distance from the shoulder radially to the outside away from the body of the sealing element and is held, preferably clamped, between the attachment part and the connector when the attachment part is attached to the connector.

The sealing element is held between the attachment part and the connector when the attachment part is attached to the connector in such a manner that the flange rests with its lower side on a contact surface of the connector and its upper side at least partially exposed. The sealing element has a foot section which, when viewed in an axial direction along the insertion direction (E), joins to the body below the flange and engages in the connector on the attachment part attached to the connector in an associated recess.

The sealing element is thus held between the attachment part and the connector in a clamping manner when the attachment part is attached to the connector so that a transition between the attachment part and the connector is sealed in a liquid-tight manner. The sealing element here has a shoulder surrounding the insertion assembly which protrudes radially towards the outside through the sealing head and—when the attachment part is attached to the connector—rests on an associated support surface of the connector. The sealing element is thus supported by the shoulder, in particular, axially along the insertion direction opposite the attachment part, so that the sealing element is axially fixed relative to the attachment part. The diameter of the sealing element in the area of the shoulder is preferably within a range of 4 mm to 10 mm, preferably 6 mm to 8 mm. Since the sealing element is supported on one side by the shoulder and on the other by its flange and the foot section, a defined, secured placement of the sealing element within the opening of the attachment part can be guaranteed.

The—in particular cylindrically formed—body of the sealing element connects to the shoulder. The sealing element as a whole has a preferably rotationally symmetrical form, where different sections of the sealing element can have different diameters. The body which connects to the shoulder is arranged with radial play in the opening of the attachment part so that a space inside the opening of the attachment part is made around the body in which the sealing element can be deformed if a delivery device is attached to the attachment part. Because a space is thus made in the opening oriented radially outward with respect to the walls of the attachment part in which the sealing element can be pushed aside if a delivery device such as a syringe with a connector is connected to the sealing element, a slot opening on the sealing head of the sealing element can be reliably opened and unhindered flow between the delivery device and the connector through the sealing element in an opened state becomes possible.

The flange which protrudes radially to the outside connects to the body. This protrudes over the body towards the outside. When the attachment part is attached to the connector, the flange is fixed or held in a clamping manner between the attachment part and the connector so that the flange itself is not clamped. This indirectly clamped mounting of the flange is accomplished in that the sealing element is supported by the connector on the one side and by the shoulder on the attachment part and by its flange and/or the foot section on the other side. The flange thus rests with only its lower side on a contact surface of the connector and its upper side preferably partially or completely exposed. The sealing element is thus fixed between the attachment part and the connector via the flange, the flange preferably being located at the end of the body opposite the shoulder and the sealing element thus supported by the shoulder on one side of the body and by the flange on the other side of the body opposite the attachment part and the connector. The diameter of the sealing element on the flange is preferably greater than the shoulder. The diameter of the flange is preferably within a range of 5 mm to 11 mm, preferably 7 mm to 9 mm. Since the flange itself is not clamped, the sealing element thus retains a certain flexibility. As a result, the sealing head can first be pushed down into the housing by the syringe connector the syringe when the syringe is connected. The side wall of the sealing element can thus radially deflect. The sealing element can then be opened when the connector presses the syringe into a slot opening in the sealing head. In particular, the radial compensation movement of the side wall can be supported by the movable arrangement of the flange.

In one embodiment, a radial outer section of the flange can initially be held in a clamping manner, for example, with an attachment part attached to a connector between a contact surface of the connector and a projection of the attachment part that protrudes radially inwards into the opening of the attachment part. The projection is preferably an annular projection. The annular projection can extend fully or only partially over the periphery of the sealing element. The sealing element can thus be placed over the annular projection, for example completely inside the opening, where the annular projection of the body projecting radially inward into the opening can be held at a radial distance from the outer walls of the attachment part that surround the opening. The annular projection can thus effect a partially clamped fixing of the sealing element between the attachment part and the connector. In addition, the annular projection can support the (centered) placement of the sealing element inside the opening with a radial distance to the attachment part's walls surrounding the sealing element. In a further embodiment, the connection between the connector and the attachment part can also be provided by the annular projection.

The sealing element is preferably formed with a convex outer side that faces away from the connector when the attachment part is attached to the connector. It is also conceivable and possible that the sealing element on its outer side is essentially flat or concavely curved towards the inside.

The outer side can in particular be in a state in which a delivery device can be connected to an attachment part projecting outward from the attachment part or flush with a surface of the attachment part so that, before attachment of the delivery device, the outer side of the sealing element can be easily accessed from the outside and wiped or dabbed off in order to sterilize it. The attachment part in this case can have a detachable part that in an initial state is integrally associated with another section of the attachment part connected to the connector and can be separated from this section, in particular broken off, to connect a delivery device to the attachment part. On the detachable part removed from the attached part, the sealing element can protrude with its outer side to the outside so that the outer side can be wiped or dabbed off from the outside. The connection assembly, and in particular also the outer side of the sealing element, can be provided in a sterile condition even in its initial state, that is, before breaking off the detachable part.

The outer side is formed on the sealing head of the sealing element. If, for example, a detachable part is removed from the attachment part, essentially only the outer side of the sealing element is exposed and projects, for example, outwardly in a convexly curved manner and can be wiped or dabbed off in a simple, reliable manner. The upper or outer side of the sealing head preferably has a diameter within a range of 3 mm to 7 mm, preferably 4 mm to 6 mm.

The shoulder is preferably located on an end of the sealing head facing away from the outer side. In the case of the connector according to the invention, no hollow body having a point intended to support the opening of the membrane is provided. No body or hollow body having a point is provided that is arranged in the interior of the sealing element and intended to support the opening of the sealing head.

According to a further embodiment, a preferably cylindrical section when viewed axially in the insertion direction (E) joins to the sealing head that merges into the shoulder which projects radially outward over the section. This section preferably has a larger diameter than that of the sealing head. The preferably cylindrically formed body can further join to the shoulder, again seen axially along the insertion direction (E), where the shoulder protrudes radially outward over the body. In addition, the body can have a recess in its outer side at a transition to the flange, preferably provided by means of or as a step. In particular, there is only a single step in the body. With this, the radial compensating movement of the sealing element when the syringe is connected is supported, for example, by a kind of bulge. In cross-section, the recess can have an essentially flat bottom. The recess can, for example, have a quadrangular cross section. The base and the radial opening of the recess can in this case have essentially the same dimensions.

A foot section, which protrudes from the flange in the insertion direction when viewed axially in the insertion direction, can join to the flange and engages in an associated recess in the connector when the attachment part is attached to the connector. An advantageous connection between the sealing element and the connector is thus created at a defined position of the sealing element within the opening of the attachment part. The sealing element can thus be supported by the shoulder on one side of the body and by the flange and/or by the foot section on the other side of the body opposite the attachment part and the connector. The sealing element preferably has a total height within a range of 6 mm to 15 mm, preferably 9 mm to 12 mm.

The sealing element preferably has a slot opening on the sealing head which, when the attachment part is attached to the connector, can be closed against liquid passage and, by joining the delivery device to the attachment part, can be opened in such a way that a medical liquid can be conveyed through the slot opening. Using such a slot opening, needle-free access is created, by means of which, for example, a container connected to the connector can be accessed when using a delivery device which has no hypodermic needle.

The delivery device can, for example, be fitted for this purpose with a connector on the sealing element, where the connector, by pressure on the sealing element, first shifts the upper side of the sealing element down and then presses it into the slot opening and thus opens the sealing element to create a flow. The delivery device then extends itself at the latest when it is fully attached—for example, screwed on tight—preferably to the connector through the slot opening of the sealing element, so that there can be an unhindered flow between the delivery device and the container through the sealing element. In one embodiment, at least 80%, preferably 90%, of the opening cross section in the delivery device through which the liquid is transported is exposed and is thus not covered by the seal. The whole cross section of the opening in the delivery device through which the liquid is transported is preferably exposed.

The attachment part is preferably formed in a single piece as a plastic molded part, preferably as a plastic injection-molded part. The attachment part here has a first section and a detachable part. The opening in which the connector engages when the attachment part is attached to the connector is preferably formed in the first section. The detachable part in its initial state is joined to the first section and can be removed, in particular broken off, from the first section in order to connect a delivery device to the attachment part. The sealing element is held on the first section and seals off the opening of the first section from the outside when the detachable part is broken off. The outer side of the sealing element in this case faces towards the outside for this and preferably projects through the first section towards the outside or is flush with the first section. In one embodiment, the attachment part provides a preferably female Luer fitting.

In one specific embodiment, the first section is formed by a connection section which can be attached to the connector and a threaded portion connecting to the connection section. The threaded portion has at least half threading for creating a threaded connection to the delivery device. The threaded connection is preferably provided by double threads. In this manner, a so-called Luer-lock connection is provided, by which a connection element in the form of a union nut can be connected to a delivery device, for example a Luer-lock syringe, to create a so-called Luer-lock connection. In its initial state, the detachable part is connected to the threaded portion and in this manner seals off the attachment part from the outside. To connect the delivery device to the attachment part, the detachable part can be removed from the threaded section, in particular broken off, so that the delivery device can be brought into connection in a screwing manner with the threaded portion via its connection element.

The threaded portion and the detachable part are preferably integral in the initial state and connected to each other in one piece. Between the threaded portion and the detachable part, a predetermined breaking point, for example in the form of a circumferential notched recess, can be provided to enable the defined removal of the detachable part from the threaded portion along a line specified by the predetermined breaking point.

The sealing element is preferably situated with its sealing head in an engagement opening of the threaded portion so that essentially only the outer side of the sealing head is accessible from the outside. Particularly if the outer side projects over the threaded portion towards the outside or terminates flush with the upper side of the threaded portion, the outside of the sealing element can be advantageously wiped or dabbed off from the outside in order to attach a delivery device to the attachment part and connect it to the connector under sterile conditions.

The connector preferably engages with a head in the opening of the attachment part when the attachment part is attached to the connector. In this case, the connector can preferably be joined by positive-lock connection to the attachment part in which, for example, a circumferential positive-lock element, such as a circumferential annular projection on the head of the connector, engages with an associated positive-lock element on the attachment piece and in this manner axially secures the attachment part with respect to the connector. In addition, one or more positive-lock elements can be provided on the head to create a rotationally stable securing of the attachment part to the head. To do this, for example, one or more webs extending parallel to the insertion direction and/or several grooves parallel to the insertion direction can be provided in which the complementary positive-lock elements on the attachment part engage when the attachment part is attached to the connector, so that the attachment part is fixed by this engagement in a rotationally stable manner to the connector.

The connection assembly and/or the sealing element can be a component of a container for medical liquids. In this case, the connector is connected to the container and creates an access to the container. By using the attachment part that can be attached to the connector and/or to the connector integrated into the connector, which can include the sealing element, a delivery device can be connected to the connector in order to convey a medical liquid into a container or out of the container.

The connection assembly can alternatively be a component of a connector to which medical lines can be connected. For example, the connection assembly can be a component of a so-called y-connector, to which two lines and, through the attachment part, also a delivery device can be connected.

A sealing element for an embodiment of the connection assembly described above and/or the connector described above is also within the scope of the invention. The sealing element includes a sealing head and a body connected to the sealing head, where the sealing element has a shoulder which projects over the sealing head radially with respect to the insertion direction and in the insertion direction can be brought into contact with an associated support surface inside the opening of a connector, and a flange which projects radially outward at a distance from the shoulder in the insertion direction facing away from the body of the sealing element and can preferably be held in a clamping manner in the connector. The flange can lie with its lower side lying on a head of the connector and its upper side at least partially exposed. In addition, a foot section which, viewed in an axial direction along the insertion direction (E), connects to the body underneath the flange, can engage in an associated recess in the head of the connector when the attachment part is connected to the connector. For possible embodiments of the sealing element, reference is made to the above description.

Also within the scope of the invention is an arrangement that includes an embodiment of the connection assembly described above or an embodiment of the sealing element described above that has a connector to attach to an attachment part, where a delivery device attached to the attachment part of the connector penetrates the slot opening of the sealing element.

Figure 2:
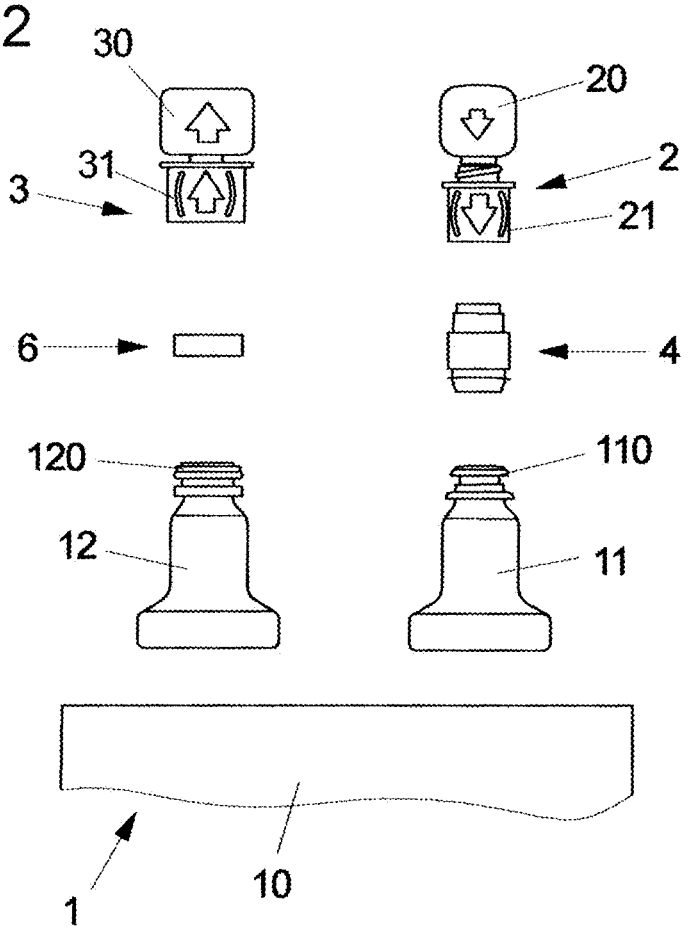
Figure 3:
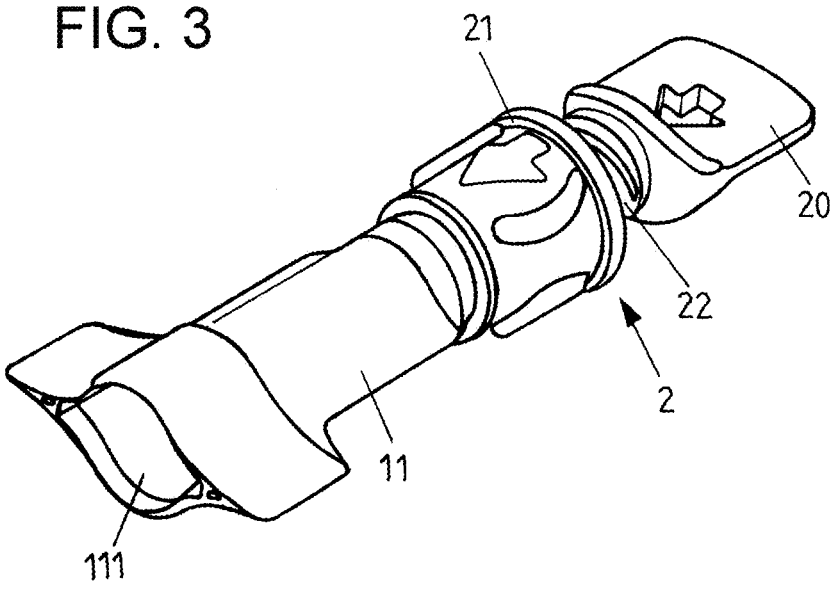
Figure 4:
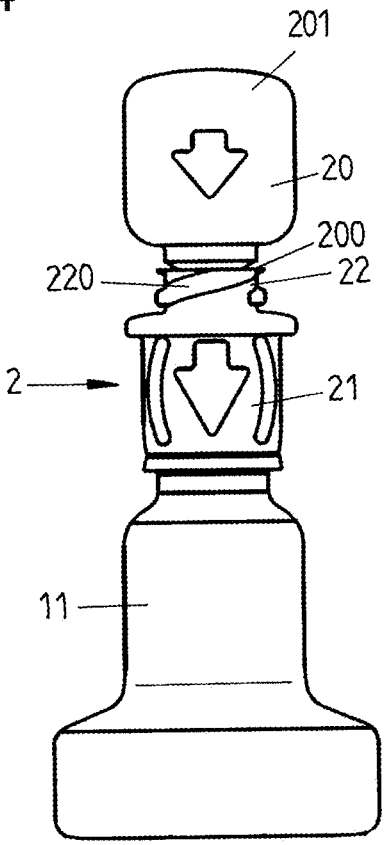
Figure 5:
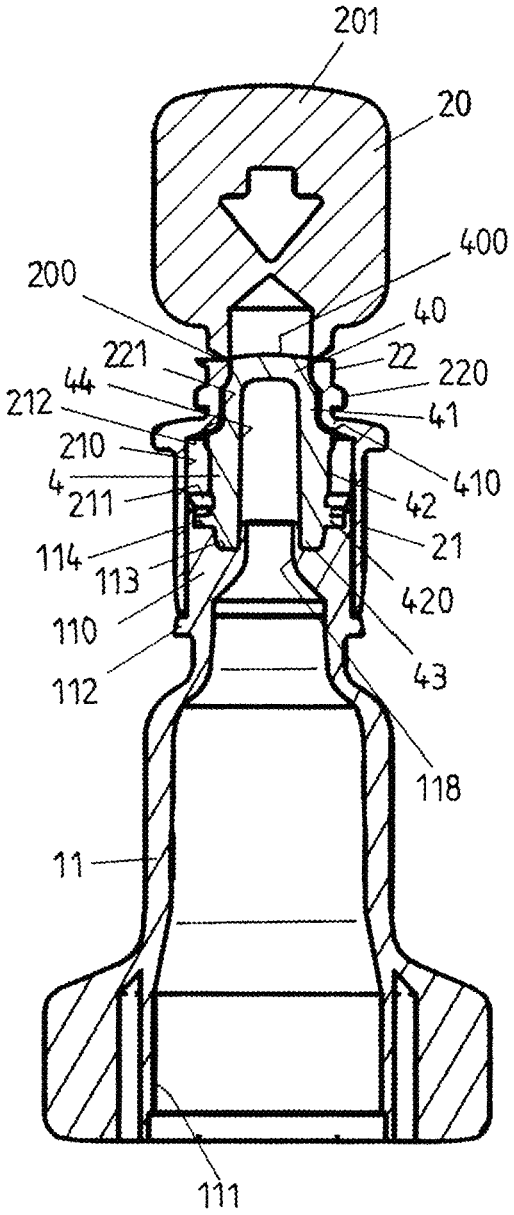
Figure 6:
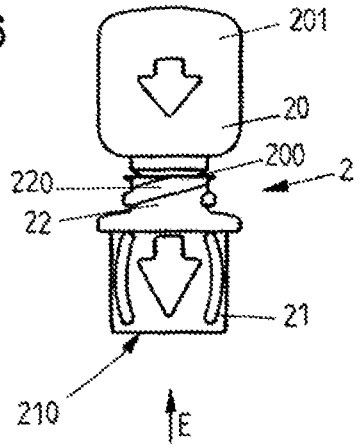
Figure 7:
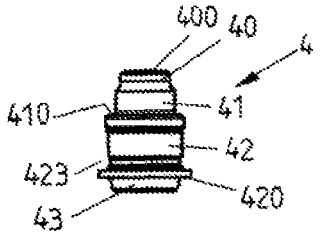
Figure 8A:
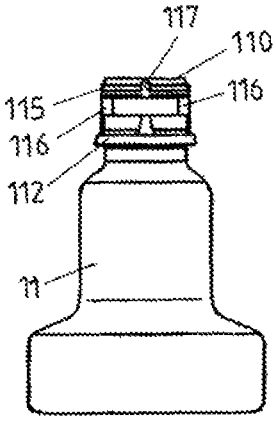
Figure 8B:
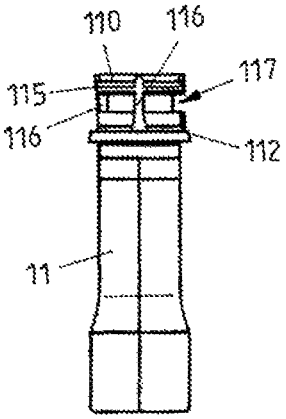
Figure 9:
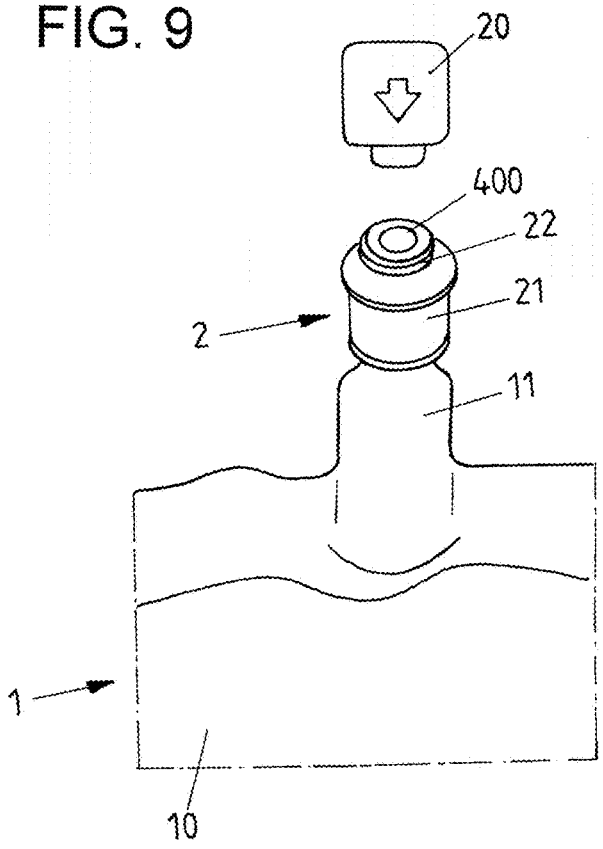
Figure 10:
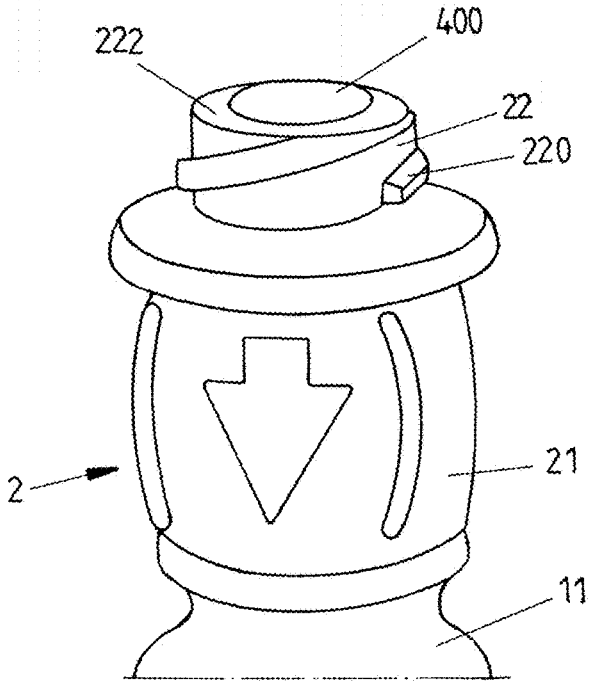
Figure 11:
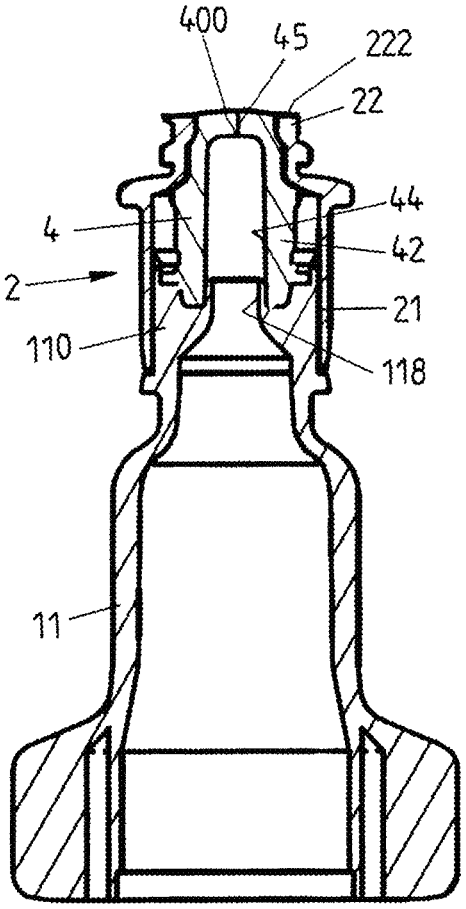
Figure 12A:
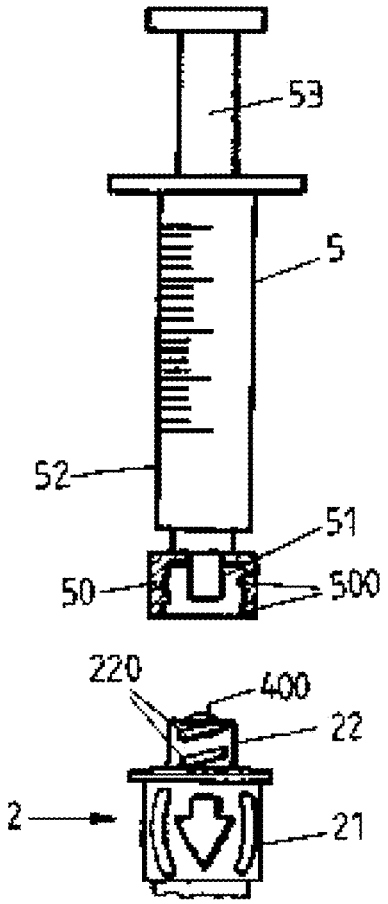
Figure 12B:
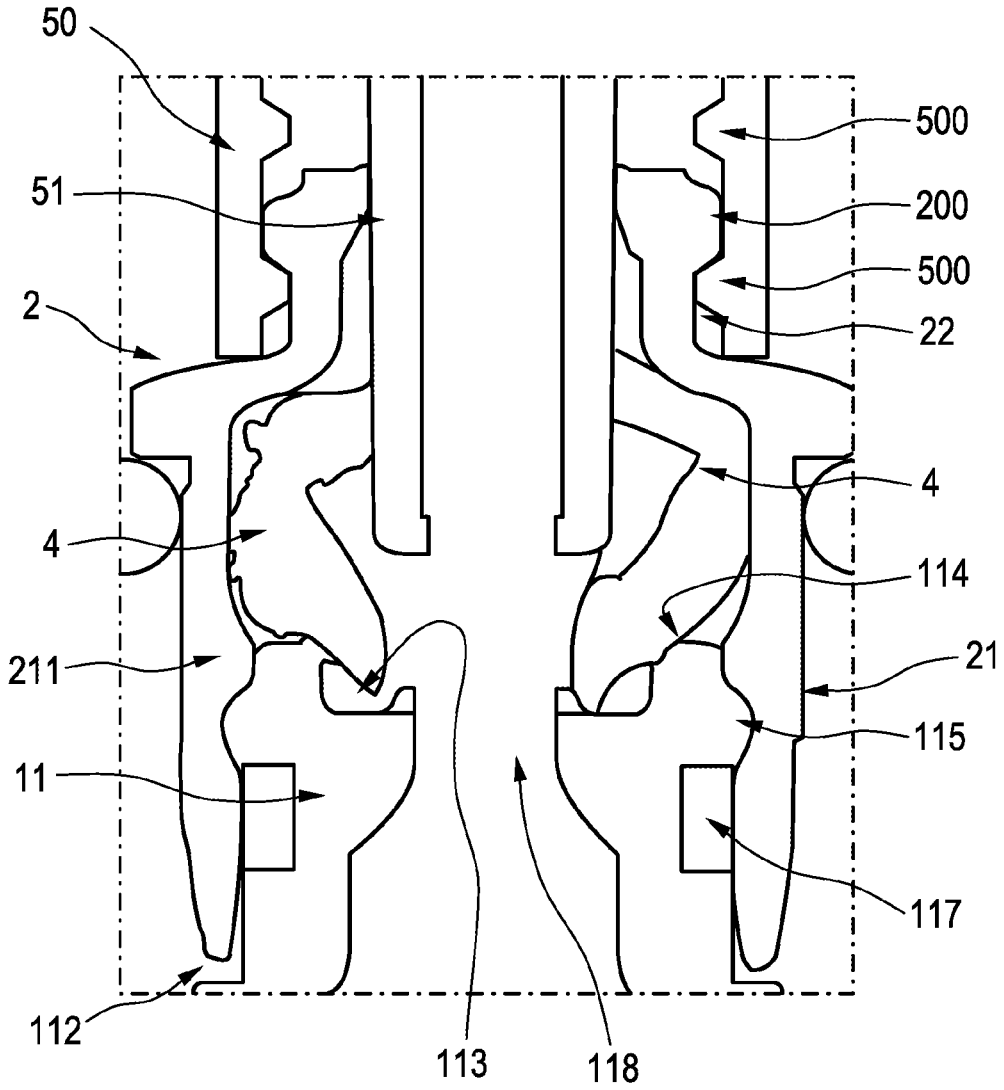
Figure 13:
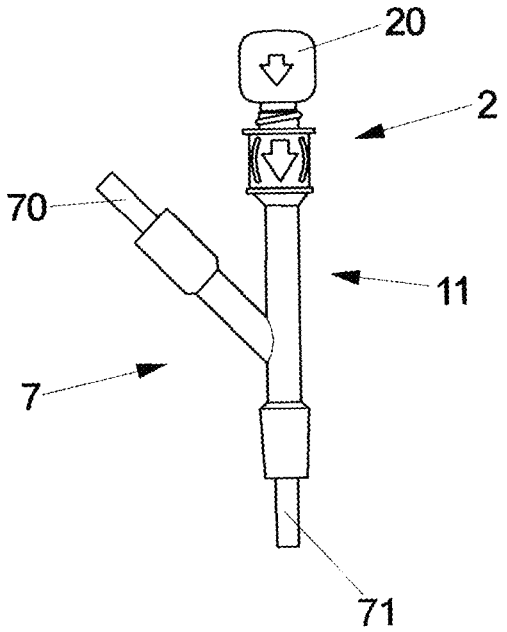

The idea underlying the invention is clarified below on the basis of the exemplary embodiment described in the figures. Shown are:

FIG. 1 a view of a container in the form of a bag with connectors arranged on it, to which attachment parts are attached;

FIG. 2 an exploded view of the connector and the attachment part with sealing elements arranged between them;

FIG. 3 a separate view of a connector with an attachment part attached;

FIG. 4 a front view of an arrangement according to FIG. 3;

FIG. 5 a sectional view on a cross-sectional plane corresponding to the drawing plane according to FIG. 4;

FIG. 6 a separate view of an attachment part;

FIG. 7 a separate view of a sealing element;

FIG. 8A a front view of the connector;

FIG. 8B a side view of the connector;

FIG. 9 a view of an attachment part on the connector with the detachable part broken off;

FIG. 10 an enlarged view of the attachment part with the detachable part broken off;

FIG. 11 the sectional view according to FIG. 5 with the detachable part broken off;

FIG. 12A a schematic view of a delivery device in the form of a syringe on the connector;

FIG. 12B a cross-sectional view of a delivery device (here in the form of a syringe) connected to the connector;

FIG. 13 a view of a connection assembly in the form of a y-connector; and

Figure 14:
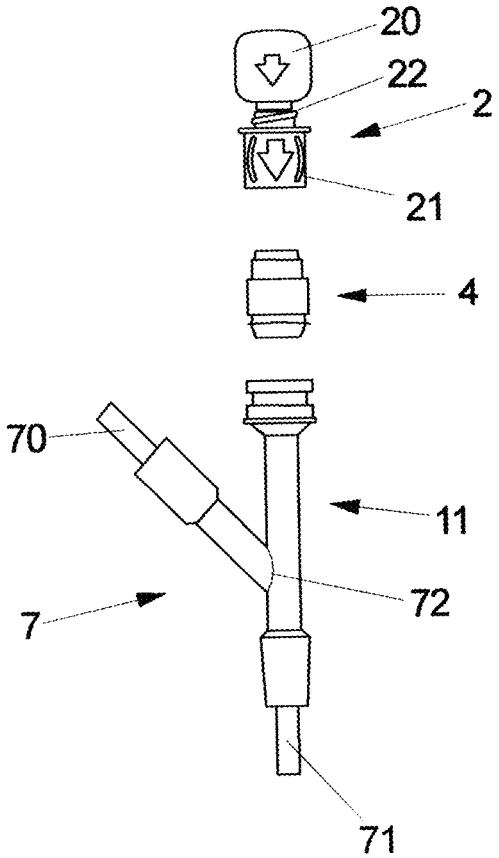

FIG. 14 an exploded view of the arrangement according to FIG. 13.

FIG. 1 shows container 1 in the form of a flexible bag, which has a bag body 10 for receiving a medical liquid, for example a medicine, a saline solution or a nutrient solution or the like. A medical liquid can be stored in container 1, wherein liquid can be filled into container 1 or removed from container 1 via connectors 11, 12.

Connectors 11, 12 create access to container 1. In the illustrated exemplary embodiment, there is a first connector 11, here designed to allow, together with attachment part 2, connection of delivery device 5 in the form of a syringe (see FIGS. 12A and 12B), so that a liquid component can be delivered into container 1 via connector 11. The second connector 12, however, together with attachment part 3, provides an access by which an infusion set, for example, can be connected to container 1 in order to supply a liquid from container 1 to a patient.

FIG. 2 shows in an exploded view the connection assemblies which are formed by connectors 11, 12, attachment parts 2, 3 and associated sealing elements 4, 6 between connectors 11, 12 and attachment parts 2, 3. Connectors 11, 12 are to be placed between sheets to create container 1 and are welded to the sheets so that connectors 11, 12 are integrally bonded to the sheets. Attachment parts 2, 3 are to be attached to connectors 11, 12 to complete container 1, so that sealing elements 4, 6 are located between attachment parts 2, 3 and connectors 11, 12 and in this manner a transition between attachment parts 2, 3 and connectors 11, 12 is sealed liquid-tight.

Each attachment part 2, 3 has a detachable part 20, 30 which can be broken off to create an access to container 1. Detachable part 20 can be broken off from attachment part 2 to attach delivery device 5 in the form of a syringe to attachment part 2 and, through it, to provide liquid into container 1. Detachable part 30 can be broken off of attachment part 3 in order, for example, to stick an infusion set with a spike through sealing element 6 and take liquid through it from container 1 to supply the liquid to a patient, for example.

Each attachment part 2, 3 also has a connection section 21, 31, which can be brought into engagement with associated connectors 11, 12, so as to create a positive lock connection between respective attachment pieces 2, 3 and associated connectors 2, 3.

The connector provided by first connector 11 and attachment part 2 attached thereto is explained below.

FIGS. 3 to 11 show an exemplary embodiment of a connector including connector 11 and attachment part 2. Connector 11 is here, as previously described, bonded to sheets of container 1 and is thus incorporated in an integral manner between the sheets. Attachment part 2 can be attached to connector 11 so that, in its attached position, attachment part 2 is held in a positive-lock manner on connector 11.

The attachment part 2 has a first section comprising connection section 21 and threaded portion 22, which connects to it, and detachable part 20. Attachment part 2 is formed in one piece as a plastic molded part and associated in its initial state with detachable part 20 attached to threaded portion 22.

Connector 11 has flow opening 111, which is closed to the outside by attachment part 2 when attachment part 2 is attached to connector 11, so that no liquid can get out of container 1 or into container 1. As is visible from the sectional view according to FIG. 5, when attachment part 2 is attached, connector 11 then engages with head 110 into opening 210 of connection section 21 and, axially via a circumferential positive-lock element in the form of annular projection 115, and via positive-lock elements 116, 117 in the form of axially extending webs and grooves is connected in a rotationally stable manner to attachment part 2. Within opening 210 of connection section 21 of attachment part 2, complementary positive-lock elements in the form of, for example, annular recesses are thus formed to engage with circumferential positive-lock element 115 and in the form of axially extending webs and/or grooves to engage with webs 116 and grooves 117.

When attachment part 2 is attached to connector 11, sealing element 4 is between attachment part 2 and connector 11 and is held in a clamping manner between attachment part 2 and connector 11. Sealing element 4 can be inserted in insertion direction E into opening 210 inside attachment part 2 (see FIG. 6). Sealing element 4, as shown in FIG. 7, is formed as a rotationally symmetrical body and has a sealing head 40, which is in engagement opening 221 of threaded portion 22 and protrudes with convexly curved or flat side 400 out past threaded portion 22 in the direction of detachable part 20. Side 400 can also, however, be flush with the upper side of threaded portion 22.

Cylindrical section 41, which merges into shoulder 410, connects to sealing head 40, which rests on circumferential conical support surface 212 in the inner transition between connection section 21 and threaded portion 22 of attachment part 2 when sealing element 4 is set into opening 210. Cylindrical section 41 here has a larger diameter than sealing head 40.

A cylindrical body 42, which is inserted with a clearance in opening 210 of connection section 21, is connected to shoulder 410, which projects radially outward past section 41 and surrounds sealing element 4. Cylindrical body 42 here has a smaller diameter than shoulder 410. Since body 42 is inserted in opening 210 with a radial distance from the circumferential wall of connection section 21, sealing element 4 can be deformed in an advantageous manner by the attachment of delivery device 5 to create a flow through sealing element 4 between delivery device 5 and container 1.

Body 42 carries a circumferential flange 420 on an end facing away from sealing head 40. Flange 420 rests with its lower side 422 on support surface 114 of connector 11. Its upper side 421 can be completely exposed. Upper side 421 is, in this case, not covered. It is not in contact or engagement with a corresponding component. For example, upper side 421 is not covered with a clamping surface of connector 2. Upper side 421 of flange 420 can also be only partially exposed. In this embodiment, flange 420 can be between annular projection 211 of connection section 21 and contact surface 114 on head 110 of connector 11 and thus be partially held in a clamping manner between annular projection 211 and contact surface 114 when attached part 2 is attached to connector 11. A radially outer section of flange 420 is held in a clamping manner.

Above flange 420 or on a transition to flange 420, cylindrical body 42 has a recess 423 in is outer side. With this, the deformation of sealing element 4 can be supported when delivery device 5 is attached. Recess 423 is formed by a step in the outer side. In cross section, recess 423 has an essentially flat bottom. Recess 423, for example, has a box-like cross section. The base and the radial opening of recess 423 can have essentially the same dimensions (as viewed in insertion direction E).

Foot section 43 connects to flange 420, which engages in recess 113 on head 110 of connector 11.

In the attached position, attachment part 2 rests at the front on outer flange 112 of connector 11.

Since sealing element 4 is supported on one side by shoulder 410 on attachment part 2 and on connector 11 by flange 420 and foot section 113 on the other, a defined, secured placement of sealing element 4 within opening 210 of attachment part 2 can be guaranteed. Through a cylindrical inner opening 44, which extends through body 42 and cylindrical section 41 of sealing element 4 starting from foot section 43 through to sealing head 40 and connects to tapered flow section 118 of connector 111, a higher flow between delivery device 5 and container 1 can be achieved when delivery device 5 is attached to attachment part 2. The inner opening 44 preferably has a diameter in a range of from 1 mm to 5 mm, preferably from 2 mm to 4 mm.

In an initial state, represented in FIG. 5, attachment part 2 is attached together with sealing element 4 to connector 11, so that connector 11 is closed toward the outside. Sealing element 4 in this initial state is not accessible from the outside because upper side 400 of sealing head 40 in opening 221 of threaded portion 22 is covered towards the outside by detachable part 20.

Detachable part 20 is connected via predetermined breaking point 200 in the form of a notch-like circumferential recess to threaded portion 22. In order to attach delivery device 5, in the form of a syringe for example, to attachment part 2 and in this manner create an access to container 1 for filling it with a liquid, a user can break detachable part 20 off of threaded portion 22 by gripping handle element 201 of detachable part 20 with his fingers and releasing detachable part 20 from threaded section 22, as is described in FIG. 9. When detachable part 20 is removed, attachment part 2 thus exists without detachable part 20, as is described in FIG. 10.

After breaking off detachable part 20, sealing element 4 has its, for example, outward-facing side 400 on sealing head 40 exposed so that this outward-facing side 400 can be accessed from the outside. In one embodiment in which side 400 is formed convexly and projects over upper side 222 of threaded portion 22 in a curved manner, side 400 of sealing element 4 can be wiped or dabbed off in an efficient manner in order to clean and disinfect sealing element 4 in accordance with any legal requirements that may be present. Flat side 400 can also be appropriately wiped or dabbed off.

Then delivery device 5 in the form of a syringe can, as shown in FIGS. 12A and 12B, be attached to threaded portion 22 by bringing connection element 50, in the form of a nut or union nut of delivery device 5, into contact with threads 220 via threads 500 on threaded portion 22 in a screw-like manner. Connecting piece 51 of delivery device 5 is inserted through this into engagement opening 221 on threaded portion 22, so that connecting piece 51 presses on sealing head 40 of sealing element 4, first presses this downward and then opens it at slot opening 45 (see FIG. 11). Connecting piece 51 thus penetrates sealing head 40 at slot opening 45 and enters into liquid communication with cylindrical opening 44 so that a flow is provided between delivery device 5 and flow opening 111 of connector 11.

With the pressing of connecting piece 51 into engagement opening 221, sealing head 40 is also pressed into attachment part 2 and, together with the other sections 41, 42, forced aside into the available space radially outside section 42. When connecting piece 51 is fully inserted, connecting piece 51 creates a positive lock connection with engagement opening 221 and reaches through sealing head 40, which creates an efficient flow connection between connecting piece 51 and flow opening 118 on head 110 of connector 11, which is not affected, or only marginally so, by sealing element 4. Delivery device 5 extends itself at the latest when in a fully attached state, here fully tightened for example, with its connecting piece 51 through slot opening 45 of sealing element 4, so that a flow between delivery device 5 and container 1 can take place unhindered, or essentially unhindered, through sealing element 4. The whole cross section of the opening in delivery device 5, through which the liquid transport takes place is preferably exposed, as shown.

Delivery device 5 has a syringe body 52 and a plunger 53, which can be pushed into syringe body 52 in order to convey in this manner a liquid from syringe body 52 into container 1.

Because a, for example, cross-shaped or straight slot opening 45 is provided in sealing head 40 of sealing element 4, a needle-free access is created which can be accessed by using delivery device 5 without an injection needle. When delivery device 5 is attached, connecting piece 51 achieves engagement with slot opening 45 and in this manner opens sealing element 4 so that a flow between delivery device 5 and container 1 is created.

After removing delivery device 5 from attachment part 2, sealing element 4 again closes automatically and seals itself, so that no liquid can escape from container 1.

FIGS. 13 and 14 show a further exemplary embodiment in which a connection assembly comprising connector 11, attachment part 2 arranged on it and sealing element 4 is used.

In this case, the connection assembly is a component of connector 7 in the form of a so-called y-connector. Connector 7 has two connection lines 70, 71 to each of which can be connected a medical line in the form of an infusion tube or the like. Line connections 70, 71 are in a flow connection with connector 11 at connection point 72 so that a medical liquid in a line system connected to line connection 70, 71 can be delivered or taken out of the line system via connector 11.

Attachment part 2 is arranged on connector 11 in this exemplary embodiment. Sealing element 4 is clamped between attachment part 2 and connector 11. As in the exemplary embodiments according to FIGS. 1 to 12, threaded portion 22 of attachment part 2 is connected to detachable part 20, which can be broken off to connect a delivery device 5 (see FIG. 12) to threaded portion 22 and to further connect delivery device 5 to connector 11. Because sealing element 4 can protrude with its convex side 400 toward the outside over upper side 222 of threaded portion 22 and is thus easily accessed, side 400 of sealing element 4 can easily be wiped off before attaching delivery device 5 in order to disinfect outward-facing side 400 of sealing element 4. Flat side 400 can also be appropriately wiped or dabbed off.

Connector 11 as well as attachment part 2 are identical in form and function to those previously described for the exemplary embodiment according to FIGS. 1 to 12B, so that the previous embodiments should be referenced.

The idea underlying the invention is not confined to the previously described examples of the exemplary embodiment, but can also be accomplished in a completely different way.

LIST OF REFERENCE NUMBERS

1 Bag
10 Bag body
11, 12 Connector
110, 120 Head
111 Flow opening
112 Flange
113 Recess
114 Bearing surface
115 Positive-lock element (annular projection)
116 Web
117 Notch
118 Flow opening
2 Attachment part
20 Detachable part
200 Predetermined breaking point
201 Handle element
21 Connection section
210 Opening
211 Annular projection
212 Contact surface
22 Threaded section
220 Threads
221 Engagement opening
222 Upper side
3 Attachment part
30 Detachable part
31 Connection section
4 Sealing element
40 Sealing head
400 Convex or flat side
41 Section
410 Shoulder
Body
420 Flange
421 Upper side of the flange
422 Bottom of the flange
423 Recess or step in the outside of the sealing element or of body 42
43 Foot section
44 Opening
45 Slot opening
5 Delivery device (syringe)
50 Connection element
500 Threads
51 Connecting pieces (syringe cone)
52 Syringe body
53 Plunger
6 Sealing element
7 Connector
(70, 71) Line connection
72 Connection point
E Insertion direction

The invention claimed is:

1. A sealing element configured to be received between a connecting member and an attachment member, the sealing element comprising:

an end portion configured to engage the connecting member;

a cylindrical body extending axially from the end portion, the cylindrical body configured to deform to create a flow path through the sealing element;

a shoulder extending axially from the cylindrical body and extending radially outward from the cylindrical body such that a largest outer diameter of the cylindrical body is smaller than a smallest outer diameter of the shoulder, the shoulder configured to engage an inner surface of the attachment member;

a cylindrical section extending axially from the shoulder, the cylindrical section configured to be received in the attachment member; and a sealing head connected to the cylindrical section.

2. The sealing element of claim 1, wherein the sealing head comprises a slot configured to be opened when the cylindrical body deforms, such that liquid can be delivered through the flow path.

3. The sealing element of claim 1, wherein the sealing element has a uniformly round cross-sectional profile.

4. The sealing element of claim 1, wherein the cylindrical body has a recess.

5. The sealing element of claim 1, wherein the sealing head has an outer surface that is substantially flat or convex.

6. The sealing element of claim 1, wherein the end portion comprises a flange and a foot portion, the flange and the foot portion being configured to engage the connecting member.

7. A sealing element configured to be received between a connecting member and an attachment member, the sealing element extending axially from a bottom end to a top end opposite the bottom end, the sealing element comprising:

a bottom end portion configured to engage the connecting member;

a cylindrical body extending axially from a top of the bottom end portion, the cylindrical body configured to deform to create a flow path through the sealing element;

a shoulder extending axially from a top of the cylindrical body and extending radially outward from the top of the cylindrical body such that a largest outer diameter of the cylindrical body is smaller than a smallest outer diameter of the shoulder, the shoulder configured to engage an inner surface of the attachment member;

a cylindrical section extending axially from a top of the shoulder, the cylindrical section configured to be received in the attachment member; and a sealing head connected to the cylindrical section at the top end of the sealing element.

8. The sealing element of claim 7, wherein the sealing head comprises a slot configured to be opened when the cylindrical body deforms, such that liquid can be delivered through the flow path.

9. The sealing element of claim 7, wherein the sealing element has a uniformly round cross-sectional profile.

10. The sealing element of claim 7, wherein the cylindrical body has a recess at a bottom of the cylindrical body.

11. The sealing element of claim 7, wherein the sealing head has an outer surface that is substantially flat or convex.

12. The sealing element of claim 7, wherein the bottom end portion comprises a flange and a foot portion, the flange and the foot portion being configured to engage the connecting member.

13. A sealing element configured to be received between a connecting member and an attachment member, the sealing element comprising:

an end portion configured to engage the connecting member;

a cylindrical body extending axially from the end portion, the cylindrical body configured to deform to create a flow path through the sealing element;

a shoulder connected to the cylindrical body and extending radially outward from the cylindrical body such that a largest outer diameter of the cylindrical body is smaller than a smallest outer diameter of the shoulder, the shoulder configured to engage an inner surface of the attachment member;

a cylindrical section extending axially from the shoulder, the cylindrical section configured to be received in the attachment member; and a sealing head connected to the cylindrical section, wherein the sealing element is formed as a single piece.

14. The sealing element of claim 13, wherein the sealing head comprises a slot configured to be opened when the cylindrical body deforms, such that liquid can be delivered through the flow path.

15. The sealing element of claim 13, wherein the sealing element has a uniformly round cross-sectional profile.

16. The sealing element of claim 13, wherein the cylindrical body has a recess.

17. The sealing element of claim 13, wherein the sealing head has an outer surface that is substantially flat or convex.

18. The sealing element of claim 13, wherein the end portion comprises a flange and a foot portion, the flange and the foot portion being configured to engage the connecting member.

19. The sealing element of claim 13, wherein:

the sealing element extends axially from a bottom end to a top end opposite the bottom end, the end portion is at the bottom end, and the sealing head is at the top end.

20. The sealing element of claim 1, wherein an outer diameter of the sealing head is smaller than the largest outer diameter of the cylindrical section.

21. The sealing element of claim 7, wherein an outer diameter of the sealing head is smaller than the largest outer diameter of the cylindrical section.

22. The sealing element of claim 13, wherein an outer diameter of the sealing head is smaller than the largest outer diameter of the cylindrical section.

* * * * *